US012589273B2

(12) United States Patent
Wu et al.

(10) Patent No.: US 12,589,273 B2
(45) Date of Patent: Mar. 31, 2026

(54) WEIGHTED VEST

(71) Applicant: VONRANG INTERNATIONAL CORPORATION, Taipei City (TW)

(72) Inventors: Chun-Yi Wu, Taipei City (TW); Tsu-Wei Liu, Taipei City (TW)

(73) Assignee: VONRANG INTERNATIONAL CORPORATION, Taipei City (TW)

( * ) Notice: Subject to any disclaimer, the term of this patent is extended or adjusted under 35 U.S.C. 154(b) by 87 days.

(21) Appl. No.: 18/810,126

(22) Filed: Aug. 20, 2024

(65) Prior Publication Data

US 2025/0121244 A1 Apr. 17, 2025

Related U.S. Application Data

(63) Continuation-in-part of application No. 29/930,013, filed on Feb. 27, 2024.

(30) Foreign Application Priority Data

Oct. 16, 2023 (TW) ..... 112305271

(51) Int. Cl.

| | |
|---|---|
| ***A63B 21/065*** | (2006.01) |
| ***A41D 1/04*** | (2006.01) |
| ***A41D 27/20*** | (2006.01) |
| ***A63B 21/00*** | (2006.01) |

(52) U.S. Cl.

CPC ..... *A63B 21/065* (2013.01); *A41D 1/04* (2013.01); *A41D 27/20* (2013.01); *A63B 21/4007* (2015.10); *A63B 2209/10* (2013.01)

(58) Field of Classification Search

CPC ..... A63B 21/065; A63B 24/0075; A63B 2225/15; A63B 2225/50; A63B 21/00065; A63B 2209/08; A63B 21/4005; A63B 21/4007; A63B 21/4009; A63B 71/0622; A63B 2209/10; A63B 2225/54; A63B 21/0603; A41D 13/0015

See application file for complete search history.

(56) References Cited

U.S. PATENT DOCUMENTS

| | | | | |
|---|---|---|---|---|
| 5,769,030 A * | 6/1998 | Acoff | A01K 27/006 | 119/856 |
| 6,554,752 B2 * | 4/2003 | Cook | A63B 21/065 | 482/93 |
| 7,707,652 B2 * | 5/2010 | Senegal | A63B 23/047 | 2/102 |
| 7,870,623 B2 * | 1/2011 | Judd | A63B 21/4007 | 5/655.4 |
| 8,262,545 B1 * | 9/2012 | Beber | A63B 21/065 | 224/264 |
| 8,800,311 B2 * | 8/2014 | Raines | A61F 7/10 | 62/259.3 |
| 9,072,935 B2 * | 7/2015 | Ross | A63B 23/047 | |

(Continued)

*Primary Examiner* — Garrett K Atkinson
(74) *Attorney, Agent, or Firm* — Bay State IP, LLC

(57) ABSTRACT

The disclosed weighted vest includes a modular design with a front and back piece body, connected via a reinforcing connection element. The vest is adjustable through detachable shoulder straps and waist bands, incorporating hook-and-loop fasteners for ease of use. The vest features compartments for weights, which can be steel plates or sandbags, providing customizable resistance for training. The design facilitates cleaning and maintenance, improving durability and user comfort.

8 Claims, 6 Drawing Sheets

(56) References Cited

U.S. PATENT DOCUMENTS 9,132,309 B2 * 9/2015 Bowers ..... A63B 21/0552
9,168,413 B2 * 10/2015 Petrakis ..... A63B 21/065
9,185,964 B2 * 11/2015 Crye ..... A45F 3/047
9,330,558 B2 * 5/2016 Logan ..... H04M 1/72412
9,521,870 B2 * 12/2016 Turner ..... A41D 13/05
9,931,531 B2 * 4/2018 Robinson ..... A63B 21/00065
9,968,141 B2 * 5/2018 Ward ..... A41D 13/0012
10,037,672 B1 * 7/2018 Abraham ..... A61B 5/02055
2003/0208832 A1 * 11/2003 VandenBerg ..... A63B 21/065
2/102
2011/0274903 A1 * 11/2011 Stuart ..... C08L 75/04
501/32
2012/0151656 A1 * 6/2012 Irwin ..... A63B 21/065
2/102
2012/0290109 A1 * 11/2012 Engelberg ..... G16H 20/30
700/91
2013/0190144 A1 * 7/2013 Ross ..... A63B 21/4007
482/105
2015/0145671 A1 * 5/2015 Cohen ..... G06Q 30/0241
340/539.11
2015/0233778 A1 * 8/2015 Casillas ..... A63B 24/00
73/865.4
2016/0000640 A1 * 1/2016 Lai ..... G16H 20/30
601/149
2016/0072802 A1 * 3/2016 Hoyos ..... G06F 16/9535
726/5
2016/0367848 A1 * 12/2016 Seuk ..... A63B 21/00065
2017/0157447 A1 * 6/2017 Brown ..... A63B 21/00065
2017/0196277 A1 * 7/2017 Henry ..... A41D 1/08
2017/0325525 A1 * 11/2017 Hyde ..... A61G 7/1051
2017/0354530 A1 * 12/2017 Shagdar ..... A41D 31/18
2018/0161616 A1 * 6/2018 Henneberry ..... A63B 21/065
2018/0193687 A1 * 7/2018 Petrakis ..... A63B 21/4005
2018/0241864 A1 * 8/2018 Males ..... H04B 17/27
2019/0022450 A1 * 1/2019 Martinoli Sanz ..... B32B 5/16
2021/0251802 A1 * 8/2021 Dijkstra ..... A41D 1/002
2022/0177090 A1 * 6/2022 Fountain ..... A63B 69/12

* cited by examiner

WEIGHTED VEST

CROSS-REFERENCE TO RELATED APPLICATIONS

This application is a continuation-in-part of U.S. application Ser. No. 29/930,013, filed Feb. 27, 2024, which is hereby incorporated herein by reference in its entirety, which U.S. application Ser. No. 29/930,013 claims priority to Taiwanese Application No. 112305271, filed on Oct. 16, 2023, which is hereby incorporated herein by reference in its entirety. This application claims priority to Taiwanese Application No. 112305271, filed on Oct. 16, 2023, which is hereby incorporated herein by reference in its entirety.

FIELD OF THE INVENTION

The present invention relates to resistance training gear, specifically a weighted vest.

BACKGROUND OF THE INVENTION

Weighted vests are commonly used gear to add resistance for resistance training. The weighted vests typically have complicated structures such as pockets for holding weights and adjustable parts to fit the user's body shape and size, making them more difficult to clean thoroughly. These designs often reduce comfort and ease of use, making the vests less convenient to don and doff. In addition, since different parts of the weighted vest may wear at different rates, when a part of the weighted vest wears out, the entire weighted vest has to be replaced. Conventional weighted vests lack the characteristics of being both separable and durable, making them less practical for long-term use.

SUMMARY OF THE INVENTION

Accordingly, one objective of the present invention is to provide a weighted vest which is separable into multiple parts for cleaning and replacement, while having good durability.

In order to overcome the technical problems in prior art, the present invention provides a weighted vest, comprising: a front piece body having a front main piece, a front left shoulder strap and a front right shoulder strap, wherein one end of the front left shoulder strap and one end of the front right shoulder strap are both connected to the front main piece, the front main piece has a front pocket for holding a weight, the front left and front right shoulder straps have a plurality of loops along their extending direction; a back piece body having a back main piece, a back left shoulder strap and a back right shoulder strap, wherein one end of the back left shoulder strap and one end of the back right shoulder strap are both connected to the back main piece, the back main piece has a back pocket for holding a weight, the back left and back right shoulder straps have a plurality of loops along their extending direction; and a reinforcing connection element having a connecting component, a left metal wire made of stainless steel and a right metal wire made of stainless steel, the connecting component being detachably mounted on the front main piece, wherein the loops of the front left shoulder strap and loops of the back left shoulder strap are alternately arranged such that the left metal wire, whose one end is connected to the connecting component and extends from the front main piece, interlaces and passes through the loops of the front left shoulder strap and the loops of the back left shoulder strap, and extends to the back main piece, and the right metal wire, whose one end is connected to the connecting component and extends from the front main piece, interlaces and passes through the loops of the front right shoulder strap and the loops of the back right shoulder strap and extends to the back main piece, and the left and right metal wires are detachably mounted on the front and back main pieces.

In one embodiment of the present invention, the weighted vest is provided, wherein the front left shoulder strap and the back left shoulder strap are fastened with each other by hook-and-loop fasteners, and the front right shoulder strap and the back right shoulder strap are fastened via hook-and-loop fasteners.

In one embodiment of the present invention, the weighted vest is provided, wherein the front left shoulder strap and the back left shoulder strap are fastened with each other by hook-and-loop fasteners, and the front right shoulder strap and the back right shoulder strap are fastened with each other by hook-and-loop fasteners.

In one embodiment of the present invention, the weighted vest is provided, wherein the reinforcing connection element is fastened to the front piece body by hook-and-loop fasteners.

In one embodiment of the present invention, the weighted vest is provided, wherein the he reinforcing connection element has a protective layer covering the left and right metal wires.

In one embodiment of the present invention, the weighted vest is provided further comprising waist bands which are fastened to the front piece body by hook-and-loop fasteners.

In one embodiment of the present invention, the weighted vest is provided, wherein the waist bands include a left waist band and a right waist band, which both have a plurality of loops, the back piece body has two rows of loops, the left metal wire interlaces and passes through the loops of the left waist band and the one row of loops of the back piece body, and the right metal wire interlaces and passes through the loops of the right waist band and the other row of loops of the back piece body to fasten the waist bands to the back piece body.

In one embodiment of the present invention, the weighted vest is provided, wherein the connecting component has a buckle to fasten the left and right metal wires.

In one embodiment of the present invention, the weighted vest is provided, wherein the front piece body and the back piece body both have padding at their inner surfaces.

With the technical means adopted by the present invention, the weighted vest is separable into the front piece body and the back piece body, wherein the front piece body and the back piece body can be firmly connected together by the reinforcing connection element and can also be easily separated by removing the reinforcing connection element, thereby facilitating washing, repairing or replacing of these parts of the weighted vest to increase the ease of cleaning, enhance comfort, facilitate donning and doffing, and prolong the lifespan of the weighted vest. In addition, since the reinforcing connection element uses metal wires for fastening, the weighted vest of the present invention is durable.

DETAILED DESCRIPTION OF THE PREFERRED EMBODIMENTS

Figure 1A:
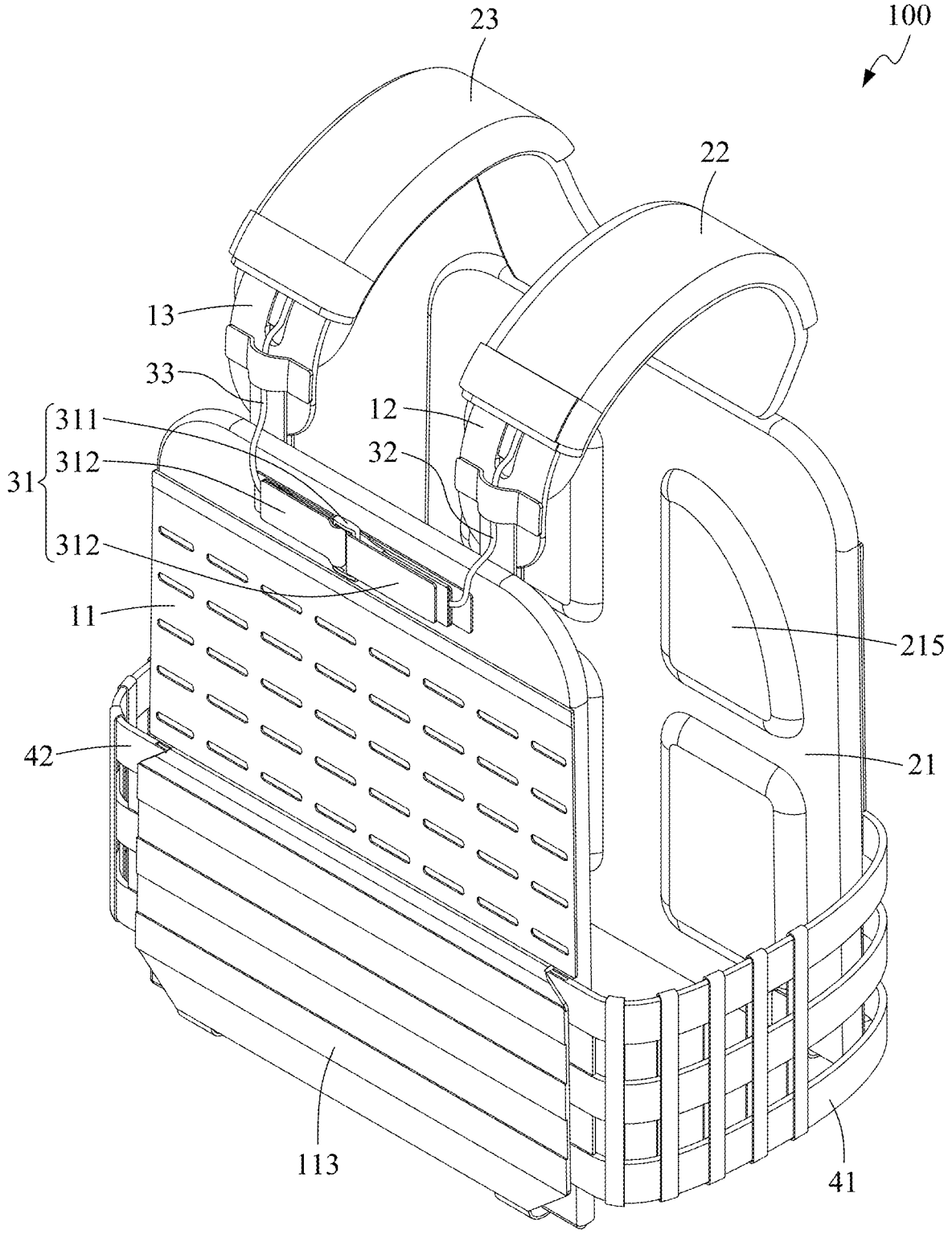
FIG. 1A is a schematic perspective drawing illustrating a weighted vest according to an embodiment of the present invention.

The preferred embodiments of the present invention are described in detail below with reference to FIG. 1A to FIG. 4. The description is used for explaining the embodiments of the present invention only, but not for limiting the scope of the claims.

As shown in FIG. 1A to FIG. 3, a weighted vest 100 according to one embodiment of the present invention includes: a front piece body 1, a back piece body 2, a reinforcing connection element 3, and waist bands 4.

Figure 3:
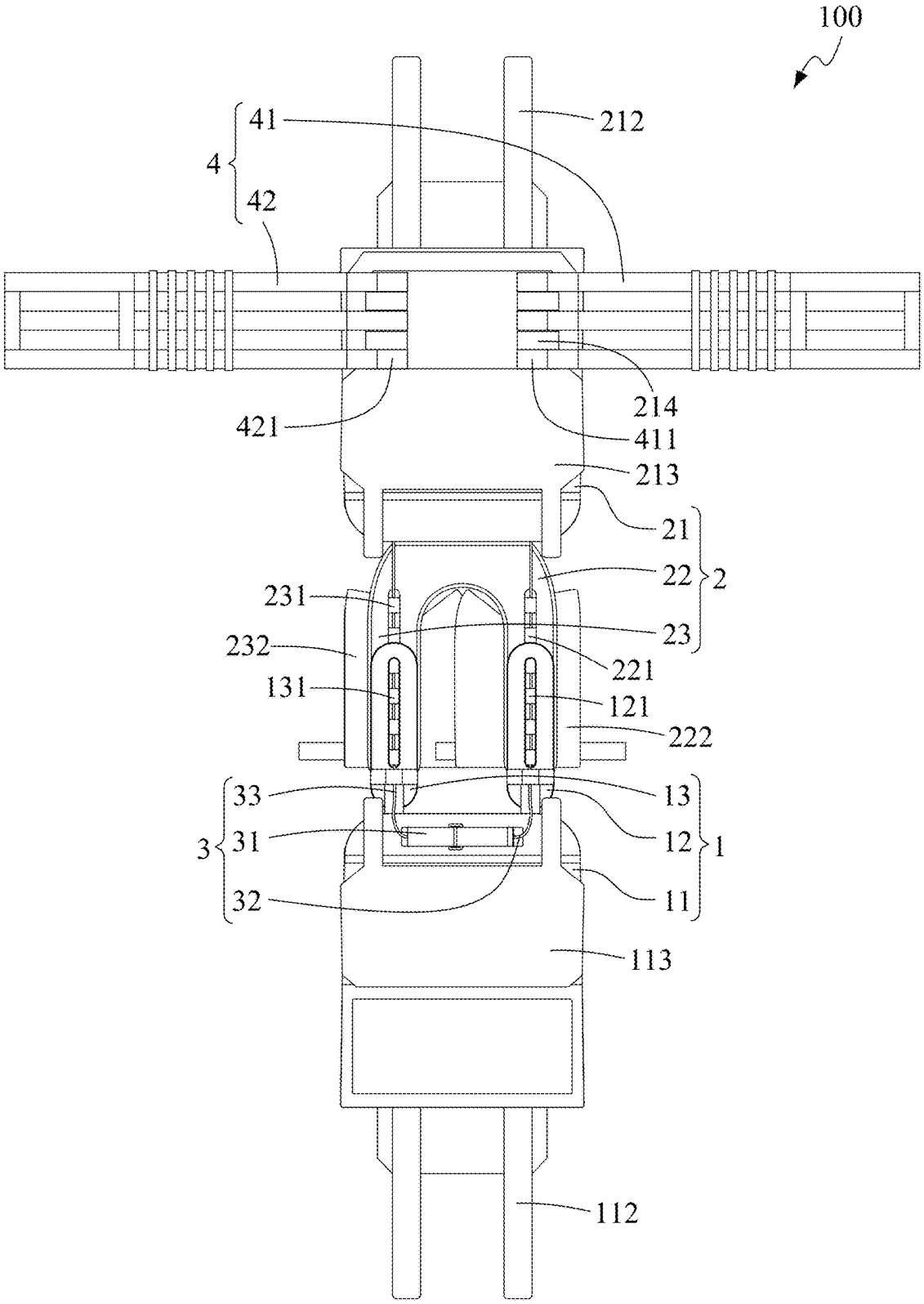
FIG. 3 is a schematic view illustrating the expanded weighted vest according to the embodiment of the present invention.

As shown in FIG. 1A and FIG. 3, the front piece body 1 has a front main piece 11, a front left shoulder strap 12 and a front right shoulder strap 13. One end of the front left shoulder strap 12 and one end of the front right shoulder strap 13 are both connected to the front main piece 11. The front main piece 11 has a front pocket 111 for holding a weight. The weight is preferably a steel plate, but it may be a sandbag or other heavy object.

Figure 2A:
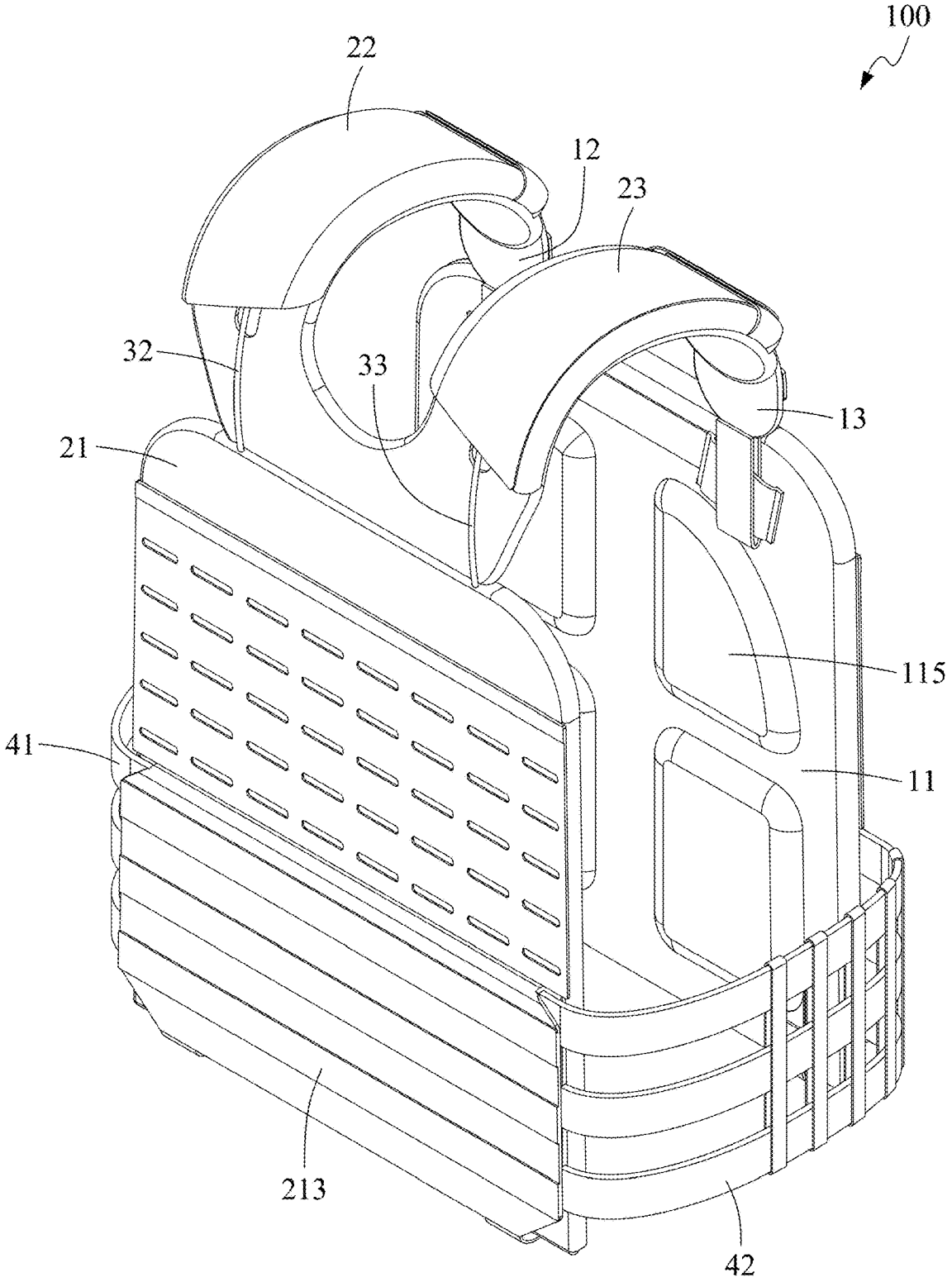
FIG. 2A is a schematic perspective drawing illustrating the weighted vest according to the embodiment of the present invention.

As shown in FIG. 2A and FIG. 3, the back piece body 2 has a back main piece 21, a back left shoulder strap 22 and a back right shoulder strap 23. One end of the back left shoulder strap 22 and one end of the back right shoulder strap 23 are both connected to the back main piece 21 by e.g. stitching. The back main piece 21 has a back pocket 211 for holding a weight.

When the weighted vest 100 is worn by a user, the front main piece 11 covers the front of the user's torso, the back main piece 21 covers the back of the user's torso, the front left shoulder strap 12 and the back left shoulder strap 22 rest on the user's left shoulder, and the front right shoulder strap 12 and the back right shoulder strap 23 rest on the user's right shoulder.

As shown in FIG. 3, the front left shoulder strap 12 and the front right shoulder strap 13 have a plurality of loops 121, 131 along their extending direction. The back left shoulder strap 22 and the back right shoulder strap 23 are provided with a plurality of loops 221, 231 along their extending direction.

Figure 4:
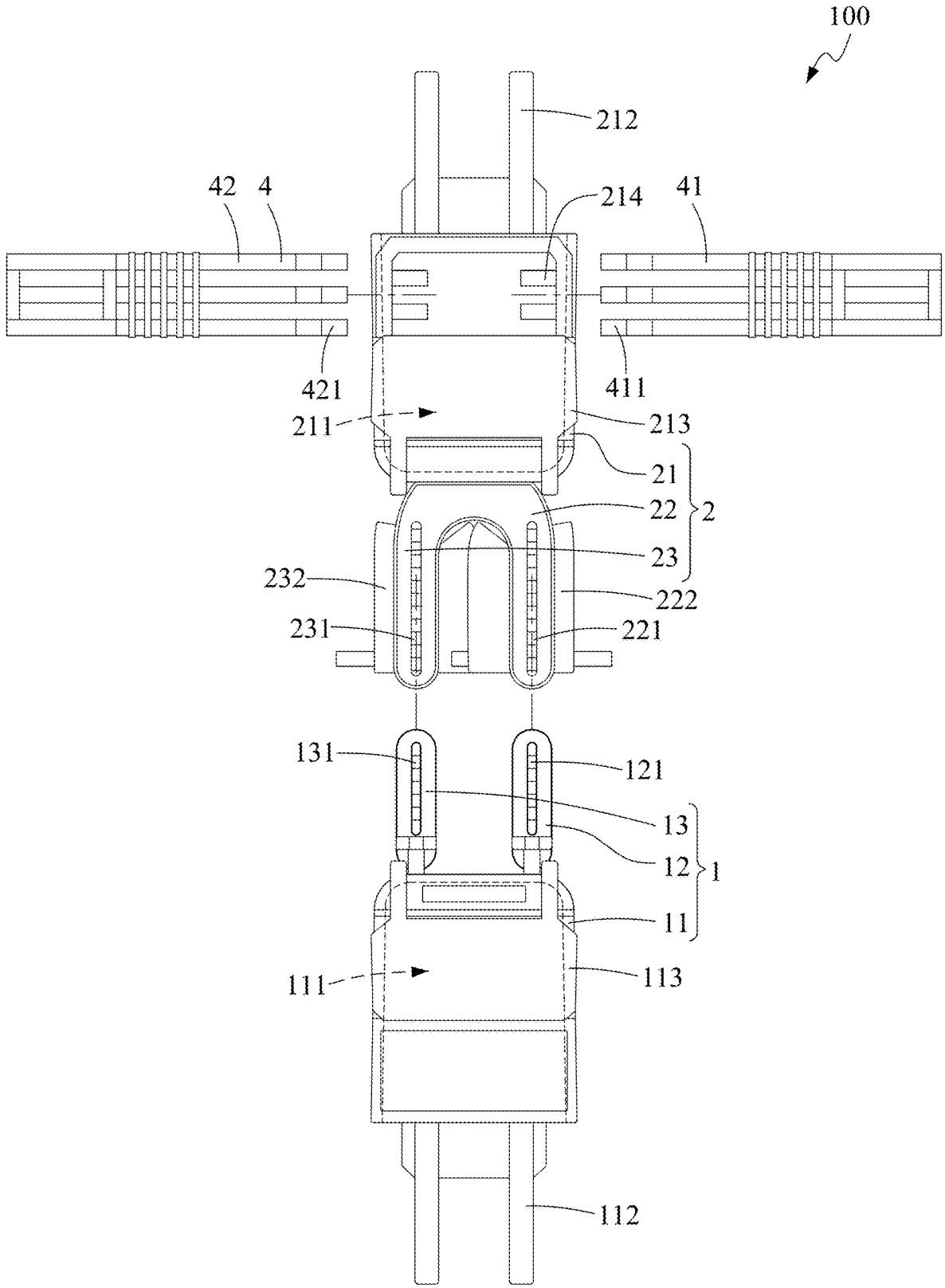
FIG. 4 is a schematic exploded view illustrating the expanded weighted vest according to the embodiment of the present invention.

As shown in FIG. 4, in this embodiment, the front pocket 111 for the weight is provided with an opening facing downward. The front main piece 11 is provided with front weight fixation straps 112 at the opening of the front pocket 111 for holding the weight in the front pocket 111. One end of each front weight fixation strap 112 is fixed to the front main piece 11 by e.g. stitching and the other end thereof is detachably mounted on the front main piece 11 by hook-and-loop fasteners so that the user can change the weights and customize the resistance provided by the weighted vest 100.

Similarly, the back pocket 211 for the weight is provided with an opening facing downward. The back main piece 21 is provided with back weight fixation straps 212 at the opening of the back pocket 211 for holding the weight in the back pocket 211. One end of each back weight fixation strap 212 is fixed to the front main piece 21 by e.g. stitching and the other end thereof is detachably mounted on the front main piece 21 by hook-and-loop fasteners so that the user can change the weight and customize the resistance provided by the weighted vest 100. In other embodiments, the opening of the front pocket 111 and/or the back pocket 211 could face upwards or sideways. Additionally, the front pocket 111 and/or the back pocket 211 could have alternative closure mechanisms.

The front main piece 11 of the front piece body 1 and the back main piece 21 of the back piece body both is provided with padding 115, 215 at their inner surfaces.

The front piece body 1 and the back piece body 2 are not sewn together. The reinforcing connection element 3 is for connecting the front piece body 1 and the back piece body 2. As shown in FIG. 3 and FIG. 4, the front piece body 1 and the back piece body 2 can be separated by removing the reinforcing connection element 3, thereby facilitating washing, repairing or replacing of the front piece body 1 and the back piece body 2 separately.

Specifically, as shown in FIG. 1A to 2B, the reinforcing connection element 3 has a connecting component 31, a left metal wire 32, a right metal wire 33, and a protective layer. Since the reinforcing connection element 3 uses metal wires 32, 33 for fastening, the weighted vest 100 of the present invention is durable. One end of the left metal wire 32 and one end of the right metal wire 33 are connected to the connecting component 31. The left and right metal wires 32, 33 are preferably stainless steel wires, but they can also be made of other metals. Preferably, the left and right metal wires 32, 33 may be covered by the protective layer made by e.g. plastic to protect the metal wires 32, 33 from the moisture and physical damage.

In this embodiment, the connecting component 31 has a buckle 311 and hook-and-loop fasteners 312. The end of the left metal wire 32 and the end of the right metal wire 33, attached to the hook-and-loop fasteners 312, are threaded through the buckle 311, folded back, and ensure the hook-and-loop fasteners 312 are fastened to the buckle 311. Since the left and right metal wires 32, 33 are connected by the hook-and-loop fasteners, they can be separated. The connecting component 31 is detachably mounted on the upper half of the front main piece 11 by the hook-and-loop fasteners 312 such that and the left and right metal wires 32, 33 are detachably mounted on the front main piece 11.

As shown in FIGS. 3 and 4, in the left side of the weighted vest 100, the loops 121 of the front left shoulder strap 12 and the loops 221 of the back left shoulder strap 22 are alternately arranged such that the left metal wire 32 extends from the front main piece 11, interlaces and passes through the loops 121 of the front left shoulder strap 12 and the loops 221 of the back left shoulder strap 22, and extends to the back main piece 21. In the right side of the weighted vest 100, the loops 131 of the front right shoulder strap 13 and the loops 231 of the back right shoulder strap 23 are alternately arranged such that the right metal wire 33 extends from the front main piece 11, interlaces and passes through the loops 131 of the front right shoulder strap 13 and the loops 231 of the back right shoulder strap 23, and extends to the back main piece 21.

As shown in FIG. 3 and FIG. 4, in this embodiment, the front left shoulder strap 12 and the back left shoulder strap 22 are fastened with each other by hook-and-loop fasteners to provide an additional connection force therebetween. The front right shoulder strap 13 and the back right shoulder strap 23 are fastened with each other by hook-and-loop fasteners to provide additional connection force therebetween. Specifically, the back left shoulder strap 22 is provided at two sides thereof with wing portions 222 that enclose the front left shoulder strap 12 and are fastened by hook-and-loop fasteners; and the back right shoulder strap 23 has two wing portions 232 that enclose the front left shoulder strap 12 and are fastened by hook-and-loop fasteners.

As shown in FIG. 2A and FIG. 3, in this embodiment, the waist bands 4 include a left waist band 41 and a right waist band 42 that connect the front piece body 1 and the back piece body 2. The left waist band 41 and the right waist band 42 are detachably mounted on the front piece body 1 and the back piece body 2, and therefore the waist bands 4 can be washed, repaired or replaced separately to increase ease of cleaning and prolong lifespan of the weighted vest 100.

Figure 2B:
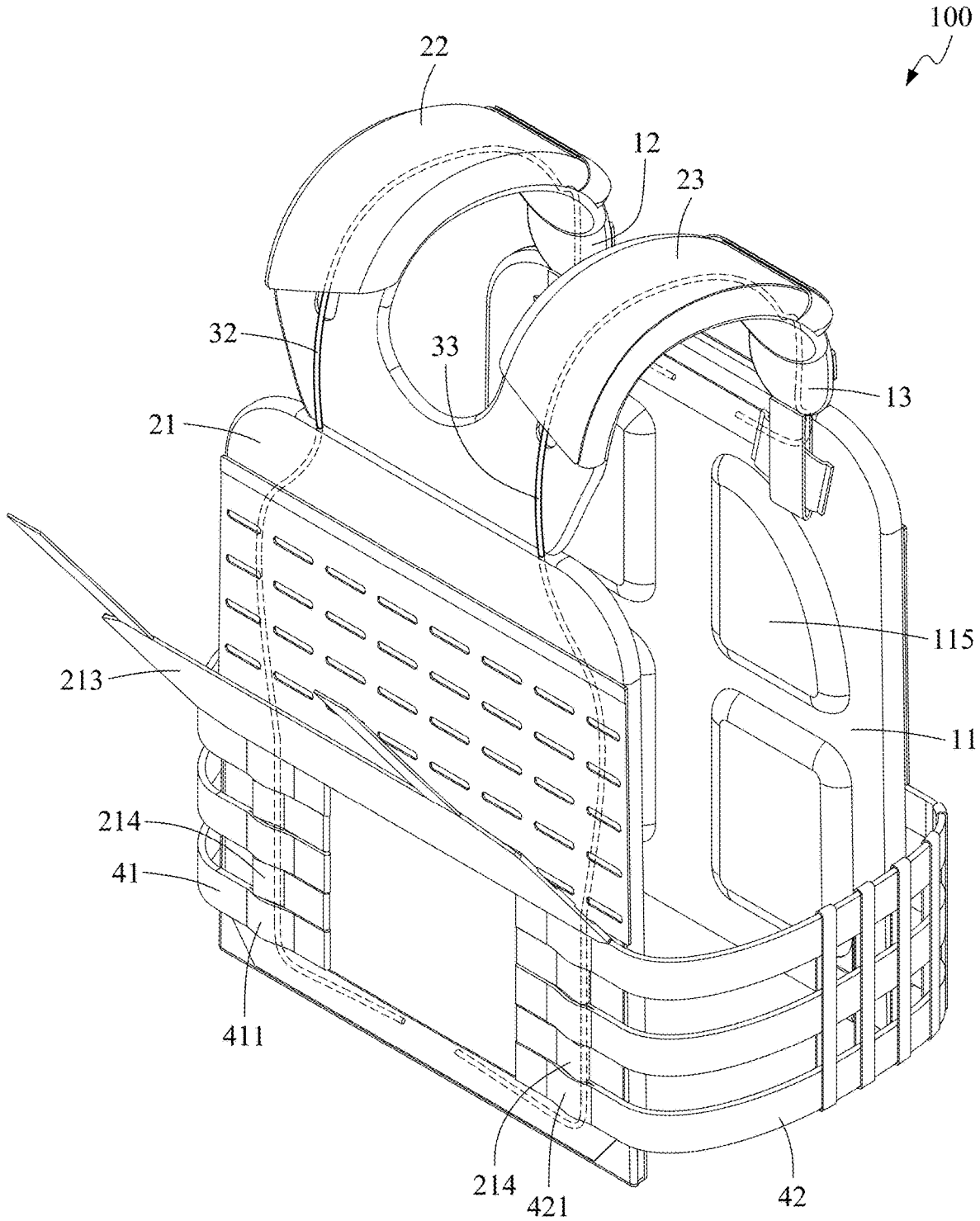
FIG. 2B is a schematic perspective drawing illustrating the weighted vest according to the embodiment of the present invention.

As shown in FIG. 2B and FIG. 3, the back main piece 21 has two rows of loops 214. The left waist band 41 and right waist band 42 both have a plurality of loops 411, 421. The left row of loops 214 of the back main piece 21 and the loops 411 of the left waist band 41 are alternately arranged such that the left metal wire 32 interlaces and passes through the left row of loops 214 of the back main piece 21 and the loops 411 of the left waist band 41 to fasten the left waist band 41 to the back main piece 21, and then the end of the left metal wire 32 is inserted into the back main piece 21. The right row of loops 214 of the back main piece 21 and the loops 411 of the right waist band 42 are alternately arranged such that the right metal wire 33 interlaces and passes through the right row of loops 214 of the back main piece 21 and the loops 421 of the right waist band 42 to fasten the right waist band 42 to the back main piece 21, and then the end of the right metal wire 33 is inserted into the back main piece 21.

Figure 1B:
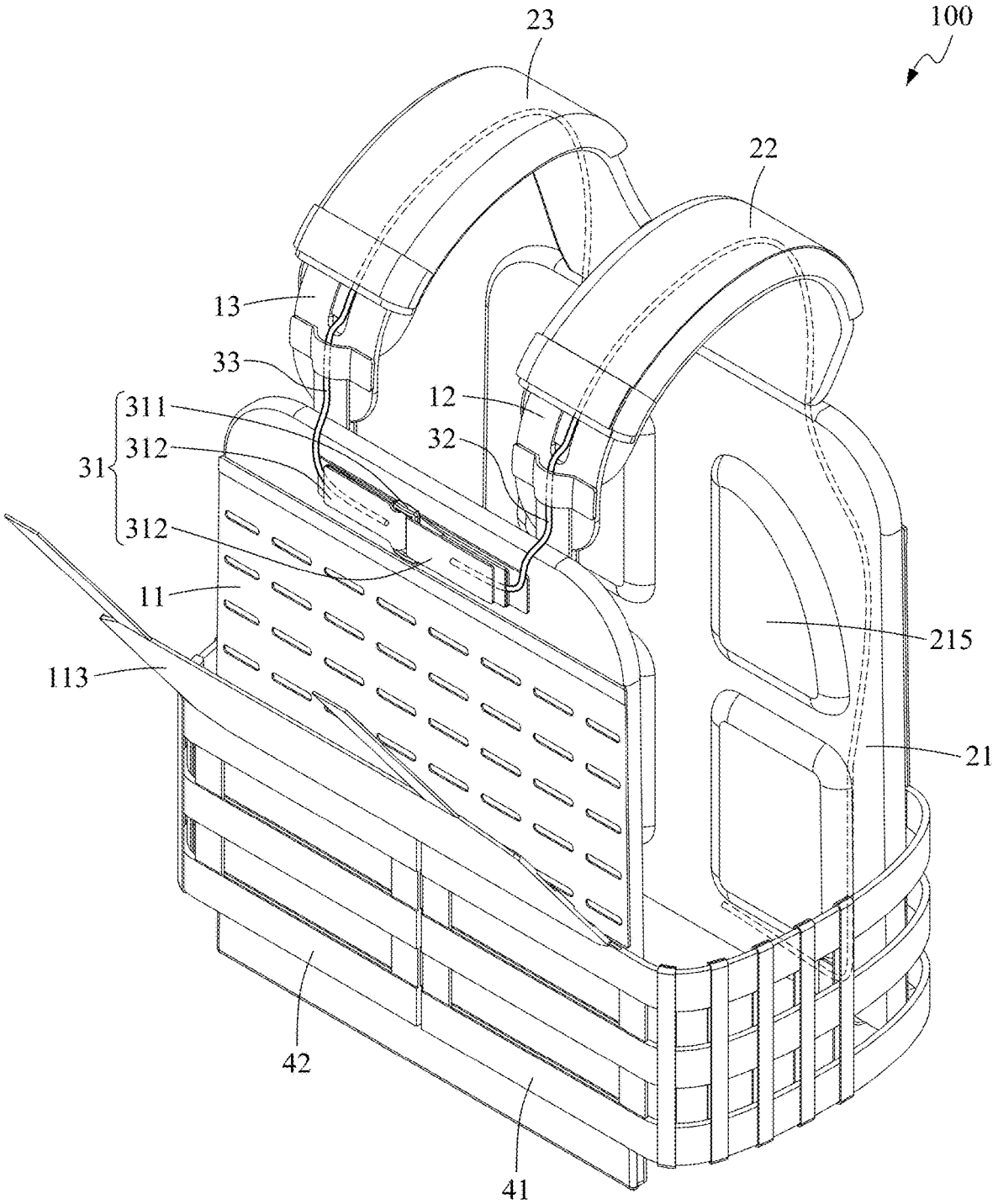
FIG. 1B is a schematic perspective drawing illustrating the weighted vest according to the embodiment of the present invention.

As shown in FIG. 1B, the front main piece 11 has a front cover 113 that covers the left and right waist band 41, 42, and fastens the left and right waist band 41, 42 in a hook-and-loop fastening manner to provide additional connection force therebetween.

As shown in FIG. 2B, the back main piece 21 has a back cover 213 that covers and fastens two rows of loops 214 of the back main piece 21 and left and right waist band 41, 42 by hook-and-loop fasteners to provide additional connection force therebetween.

The above description should be considered as only the discussion of the preferred embodiments of the present invention. However, a person having ordinary skill in the art may make various modifications without deviating from the present invention. Those modifications still fall within the scope of the present invention.

What is claimed is:

1. A weighted vest, comprising:

a front piece body having a front main piece, a front left shoulder strap and a front right shoulder strap, wherein one end of the front left shoulder strap and one end of the front right shoulder strap are both connected to the front main piece, the front main piece has a front pocket for holding a weight, the front left and front right shoulder straps have a plurality of loops along their extending direction;

a back piece body having a back main piece, a back left shoulder strap and a back right shoulder strap, wherein one end of the back left shoulder strap and one end of the back right shoulder strap are both connected to the back main piece, the back main piece has a back pocket for holding a weight, the back left and back right shoulder straps have a plurality of loops along their extending direction; and a reinforcing connection element having a connecting component, a left metal wire and a right metal wire, the connecting component being detachably mounted on the front main piece, wherein the loops of the front left shoulder strap and loops of the back left shoulder strap are alternately arranged such that the left metal wire, whose one end is connected to the connecting component and extends from the front main piece, interlaces and passes through the loops of the front left shoulder strap and the loops of the back left shoulder strap, and extends to the back main piece, and the right metal wire, whose one end is connected to the connecting component and extends from the front main piece, interlaces and passes through the loops of the front right shoulder strap and the loops of the back right shoulder strap and extends to the back main piece, and the left and right metal wires are detachably mounted on the front and back main pieces.

2. The weighted vest of claim 1, wherein the front left shoulder strap and the back left shoulder strap are fastened with each other by hook-and-loop fasteners, and the front right shoulder strap and the back right shoulder strap are fastened with each other by hook-and-loop fasteners.

3. The weighted vest of claim 1, wherein the reinforcing connection element is fastened to the front piece body by hook-and-loop fasteners.

4. The weighted vest of claim 1, wherein the reinforcing connection element has a protective layer covering the left and right metal wires.

5. The weighted vest of claim 1, further comprising waist bands which are fastened to the front piece body by hook-and-loop fasteners.

6. The weighted vest of claim 5, wherein the waist bands include a left waist band and a right waist band, which both have a plurality of loops, the back piece body has two rows of loops, the left metal wire interlaces and passes through the loops of the left waist band and the one row of loops of the back piece body, and the right metal wire interlaces and passes through the loops of the right waist band and the other row of loops of the back piece body to fasten the waist bands to the back piece body.

7. The weighted vest of claim 1, wherein the connecting component has a buckle to fasten the left and right metal wires.

8. The weighted vest of claim 1, wherein the front piece body and the back piece body both have padding at their inner surfaces.

* * * * *